United States Patent [19]

Sutton et al.

[11] 4,389,374

[45] Jun. 21, 1983

[54] CENTRIFUGE TUBE HOLDER

[75] Inventors: John H. Sutton, Belmont; Rebecca J. Woodruff, Fremont, both of Calif.

[73] Assignee: Beckman Instruments, Inc., Fullerton, Calif.

[21] Appl. No.: 278,772

[22] Filed: Jun. 29, 1981

[51] Int. Cl.[3] ..... B01L 9/06

[52] U.S. Cl. ..... 422/104; 206/201; 422/72; 422/102

[58] Field of Search ..... 211/74; 233/26; 206/201, 203; 422/72, 102, 104; 435/296, 809

[56] References Cited

U.S. PATENT DOCUMENTS

| | | | |
|---|---|---|---|
| 2,110,308 | 3/1938 | Nelson | 73/373 |
| 2,755,018 | 7/1956 | Grela et al. | 233/26 |
| 3,454,217 | 7/1969 | Harbott | 233/26 |
| 3,554,703 | 1/1971 | Moss | 422/68 |
| 3,674,198 | 7/1972 | Eberle | 233/26 |
| 3,682,323 | 8/1972 | Bergquist et al. | 211/74 |
| 4,135,660 | 1/1979 | Conn et al. | 233/26 |
| 4,198,484 | 4/1980 | Reichler et al. | 435/296 |
| 4,284,603 | 8/1981 | Korom | 211/74 |

*Primary Examiner*—Michael S. Marcus

*Attorney, Agent, or Firm*—R. J. Steinmeyer; F. L. Mehlhoff; William H. May

[57] ABSTRACT

A centrifuge tube holder capable of being manually assembled and disassembled without separate tooling to provide not only ease of cleaning, but also interchangeability of parts to accommodate various sized centrifuge tubes. The tube holder arrangement provides proper support with a minimum of parts to create a lighter weight assembly for use in a centrifuge rotor.

1 Claim, 7 Drawing Figures

CENTRIFUGE TUBE HOLDER

BACKGROUND OF THE INVENTION

The present invention is directed to centrifuge tube holders and, more specifically, is directed to a centrifuge tube holder having parts which are easily disassembled to allow ready interchangeability with substitute parts to accommodate various sized centrifuge tubes.

The proper design of an ultracentrifuge rotor requires that the weight of the rotor be minimized while not degrading the requisite strength of the rotor. In other words, it is a design goal in each rotor to be able to eliminate as much weight as possible, so that not only more weight can be allocated to the fluid samples which are to be placed in the rotor, but also greater performance speeds can be achieved. If the rotor structure itself can be made lighter, more weight in the form of fluid samples can be placed in the rotor for the centrifugation run. Similarly, when less weight is utilized in the rotor construction, the maximum rpm operational speed of the rotor can be increased.

In some rotor designs, it is desirable to carry a plurality of centrifuge tubes as a group in swinging buckets or containers that are connected to a rotor frame. However, in order to adequately support centrifuge tubes in these rotor buckets, it is necessary to provide for some type of centrifuge tube holder. Typically the holder arrangements are comprised of some type of block or disc arrangement which has a plurality of holes for the receipt of a plurality of centrifuge tubes. Unfortunately, a significant amount of weight is contributed to the overall rotor weight by the utilization of these blocks to support the centrifuge tubes within the rotor buckets.

It is a desire with respect to any type of centrifuge tube holder that it be easily or readily cleaned since, in the course of numerous centrifugation runs, some centrifuge tubes may break due to defects. Consequently, the contents of the fluid sample will leak onto the holder assembly. After the centrifugation run, it is necessary to clean the centrifuge tube holder. However, in some centrifuge tube holder designs, the configuration is such that proper cleaning of the holder is very difficult, since there are many angular junctions in the holder which prevent efficient and good cleaning.

In some present holder assemblies for centrifuge tubes, there are set configurations with respect to the size tubes which can be accepted by the adapter or the holder assembly. In order to accommodate different size centrifuge tubes, it is necessary to replace the entire holder assembly.

SUMMARY OF THE INVENTION

The present invention is a centrifuge tube holder assembly which incorporates four detachable pieces which are assembled to form the holder assembly. The assembly or disassembly of the parts constituting the holder assembly can be easily accomplished manually without the requirement of a separate tool. The disassembly of the constituent parts of the holder assembly allow for the ease of cleaning of the assembly. Further, the basic construction of having a base with a top section in spaced relation to the base for holding the tubes eliminates a considerable amount of added weight that normally would be associated with a tube holder.

The present invention, being disassembled, allows for the interchangeability of various parts in the assembly. This is an important feature with respect to the ability to accommodate different size centrifuge tubes. Not only is the portion having a plurality of apertures for holding the centrifuge tubes replaceable to accommodate different diameter size centrifuge tubes, but also the side panels which hold the base and the top in a spaced relationship to each other are interchangeable to adjust the distance of the spaced relation between the top and the base to accommodate various length centrifuge tubes that are used.

The use of the separate parts which are oriented in spaced relationship to each other greatly reduces the amount of weight required for the centrifuge tube holder assembly and thereby allows for greater speed of the rotor and/or greater weight allocation in the centrifuge tubes for holding the fluid samples.

Typically, the present invention incorporates fewer parts than found in prior utilized types of tube holders. The fewer parts required and the ease of disassembly provides a holder which can be easily shipped to the customer in a minimum of space for ease in packing.

DETAILED DESCRIPTION OF THE INVENTION

Figure 1:
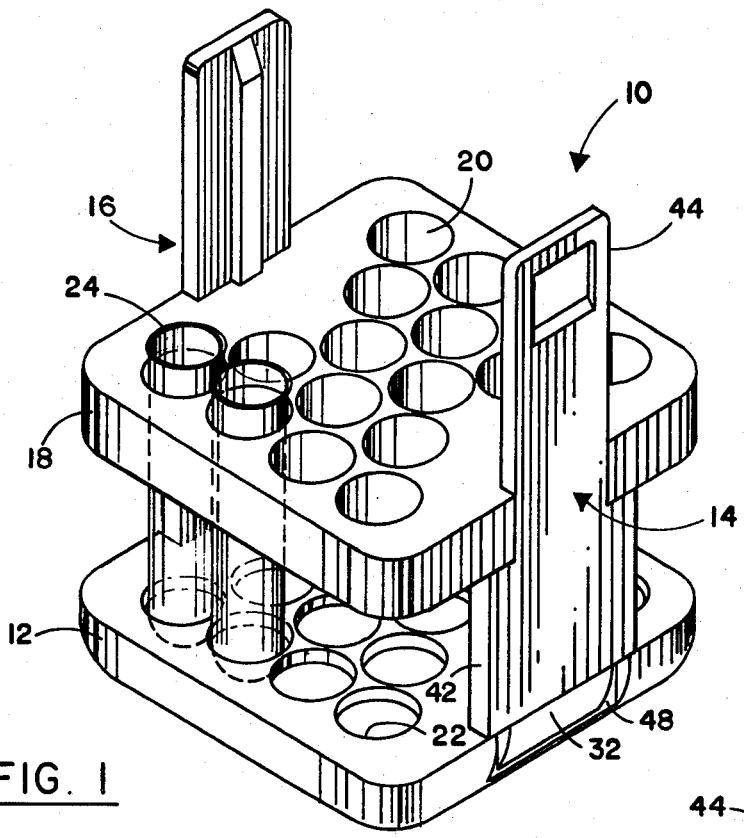
FIG. 1 is a perspective view of the tube carrying assembly.

The holder assembly 10 is shown in FIG. 1 having a base 12 to which are attached two side panels 14 and 16. Mounted in spaced generally parallel arrangement with the base 12 is a top or upper plate 18. The side panels 14 and 16 are designed to secure the top 18 in its spaced relationship with respect to the base 12. Located in the top 18 are a plurality of apertures 20 which are designed to be aligned with a plurality of recesses 22 in the base 12. The combination of the aligned apertures 20 and recesses 22 is designed to receive a plurality of centrifuge tubes 24. Once the desired number of centrifuge tubes 24 have been placed in the tube holder assembly 10, the entire assembly is designed to be placed in a centrifuge rotor container or bucket which is subjected to centrifugal forces during a centrifugation run.

Figure 2:
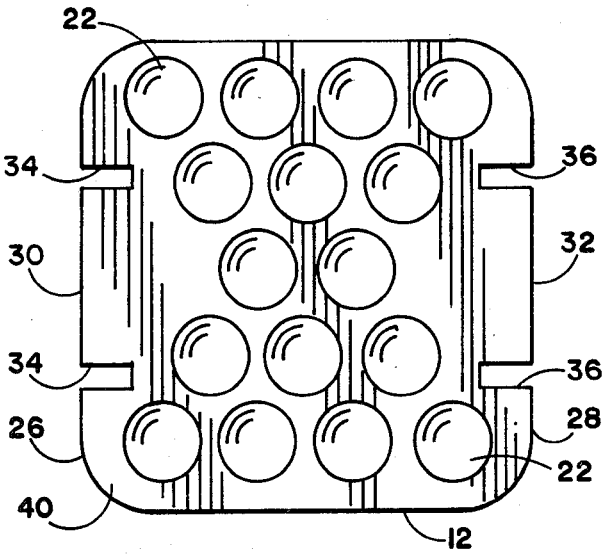
FIG. 2 is a top view of the base.
Figure 3:
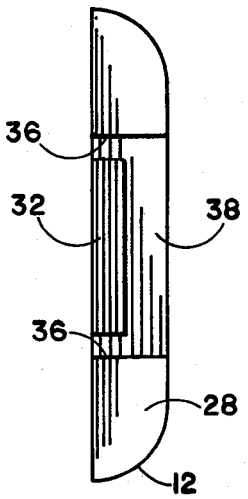
FIG. 3 is a side view of the base of the holder assembly.

Attention is directed to FIGS. 2 and 3, showing the bottom 12 in more detail. Integrally formed on opposite sides 26 and 28 of the base 12 are respective tongue sections 30 and 32. These tongue sections are separated from the respective sides 26 and 28 by grooves or slots 34 and 36. As shown more clearly in FIG. 3, the tongue section 32 extends from a recessed area 38 of the side 28. This arrangement of the tongue 32 and 30 in conjunction with the slots 34 and 36 is designed to provide interface with the side panels 14 and 16 of FIG. 1 as will be explained below. As stated previously, the top surface 40 of the base 12 has a plurality of recesses 22 which are designed to receive the bottom curved portions of centrifuge tubes.

Figure 4:
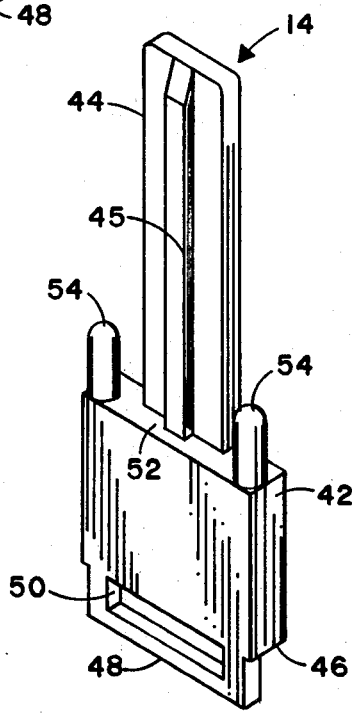
FIG. 4 is a perspective view of a side panel of the tube holder assembly.

FIG. 4 shows the side panel 14 which is of the same construction as the side panel 16 in FIG. 1. The side panel has a main support portion 42 from which extends a handle arm 44. Integrally formed at the bottom 46 of the support port 42 is a loop 48. The loop 48 forms an interior opening 50 which is designed to receive the tongue 32 of the bottom 12 shown in FIG. 3. The size of the tongue 32 is such that it provides a tight fit with the loop 48. The base 12 is preferably made of rubber and, therefore, provides a tight fit with the side panel 14 which is made of a glass filled polypropylene. The base member is preferably made of a natural rubber (Durameter 70). Projecting from the top 52 of the support portion 42 of the side panel 14 in FIG. 4 are connecting pins 54 which are designed to provide interconnect with the top 18 shown in FIG. 1.

Figure 5:
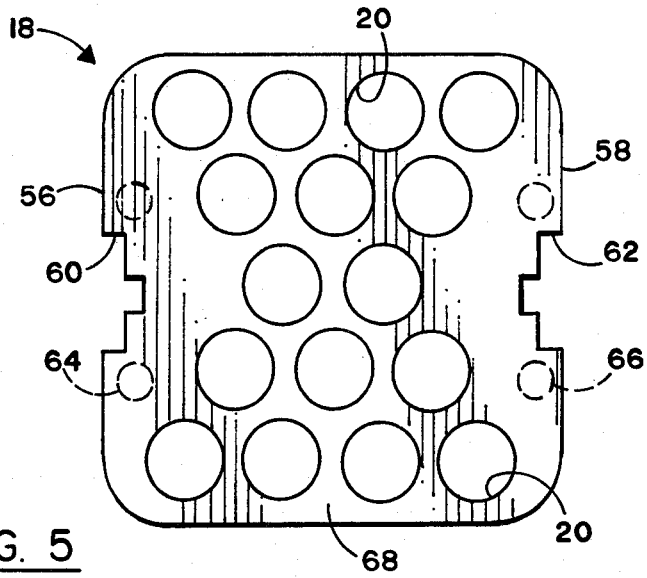
FIG. 5 is a top view of the top of the holder assembly.

The top 18 is shown in FIG. 5 having a plurality of apertures 20 which are designed to receive the centrifuge tubes 24. Also, it should be noted that the pattern of recesses 22 in the base of FIG. 2 is designed to be the same as the pattern of apertures 20 in the top 18 in FIG. 5. Therefore, there will be alignment between the apertures 20 and the recesses 22. Since the base 12 is made of natural rubber, there is no need to provide any type of adapters or inserts in the base for a cushion to the bottom of the test tubes. The top 18 in FIG. 5 has on its opposite sides 56 and 58 the respective T-shaped slots 60 and 62 which are designed to receive the projecting handle arm 44 of the side panel 14 in FIG. 4 with its central rib 45. Also located in the top 18 adjacent each of the T-shaped slots 60 and 62 are respective pairs of holes 64 and 66 which are designed to receive the connecting pins 54 of the side panel 14. Also located on the top surface 68 of the top 18 are labeled indicia for each of the apertures 20 in order to guide the user in the proper balanced loading of the tube holder assembly.

Figure 6:
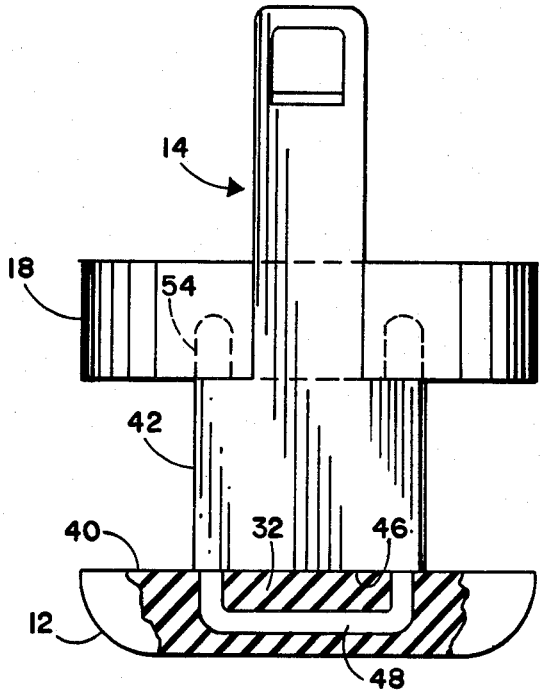
FIG. 6 is a side view and partial sectional view of the holder assembly.
Figure 7:
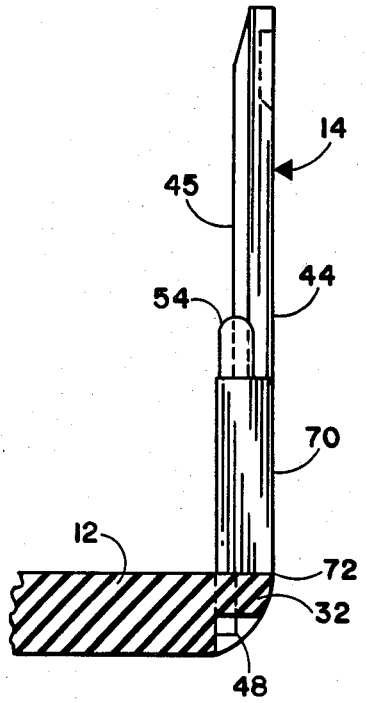
FIG. 7 is a partial side view of a side panel attached to the base of the holder assembly.

FIG. 6 shows in more detail the assembly of the base 12 to the side panel 14 and the top 18. The loop 48 of the side panel 14 is positioned over the tongue 32 in the base 12. As stated previously, the base is preferably made of natural rubber and, therefore, is designed to have the tongue fit tightly within the loop 48. Also, the bottom 46 of the side panel 14 is designed to rest on the top surface 40 of the base. Reference is made to FIG. 7 showing in further detail the interface between the tongue 32 and the loop 48. The outside surface 70 of the side panel 14 is designed to be in alignment with or flush with the edge 72 of the base 12.

The top 18 in FIG. 6 is positioned with its holes 66 in alignment with the connecting pins 54 of the side panel 14. Also, the interior surface of the slot 62 is in face-to-face tight relation to the interior side 74 of the extending arm 44 of the side panel 14.

Once the entire assembly is constructed as shown in FIG. 1, the two side panels 14 and 16 in conjunction with the base 12 and top 18 form a very strong holder for the support of the centrifuge tubes 24. The typical order of assembly is the connection of the side panels 14 and 16 to the base 12 followed by the attachment of the top 18 in place onto the pins 54 of the side panels. As stated previously, the entire assembly 10 is designed for easy disassembly in order to enhance cleaning.

It also should be noted that the ease with which the assembly and disassembly of the tube holder assembly 10 is accomplished allows for the substitution of various component parts to accommodate varying sized centrifuge tubes. For instance, the base 12 and top 18 could be replaced by another series of recesses 22 and apertures 20 for larger or smaller diameter centrifuge tubes. Similarly, the side panels 14 and 16 could be interchanged with panels which would provide for a greater spacing between the base and the top to accommodate centrifuge tubes of longer length. The utilization of the spacing aspect of the base with respect to the top allows for the adequate support of the centrifuge tubes while at the same time eliminating much weight and bulk to the holder. This, as explained previously, enables the user to incorporate more fluid sample in the centrifuge tubes or, in some instances, may allow for greater speeds of centrifugation.

Although a particular rectangular arrangement has been shown for the holder of the present invention, it is envisioned that other configurations could be used embodying the same principles of the easily disassembled and assembled concept of relatively few parts. Further, it is envisioned that the concept of the interchangeability of parts could be accomplished by other mechanical means which would enhance the relatively easy disassembly and assembly. Possible uses of easily removable screws, pins or straps may be incorporated to accomplish the same end result of the present invention.

What is claimed is:

1. A centrifuge tube holder assembly comprising:

a base having a specified perimeter;

a top having a perimeter the same shape and size as said specified perimeter of said base;

a pair of side panels detachably connected to said base and top to secure and maintain said top and bottom in a spaced apart relationship, each of said side panels having an upwardly extending handle-arm for holding or securing said assembly;

a tongue section on opposite sides of said base and a loop on the bottom of each of said pair of side panels, said loops of said pair of side panels receiving said tongue sections of said base, said tongue sections being recessed within said base, said side panels being within said specified perimeter when attached to said base;

at least two connecting pins on each of said pair of side panels and at least two holes on said top for receipt of said connecting pins for securing said top to said side panels, said top having slots to receive said side panels, said side panels being within said perimeter of said top when attached to said top, said tongue sections and said slots acting cooperatively with said side panels so that said specified perimeter is not enlarged by the attachment of said side panels to said base and said top; and means in said top and base for locating and positioning centrifuge tubes.

* * * * *